US007239943B2

(12) United States Patent
Peltz

(10) Patent No.: US 7,239,943 B2
(45) Date of Patent: Jul. 3, 2007

(54) OPERATOR LOCATION TRACKING FOR REMOTE CONTROL RAIL YARD SWITCHING

(75) Inventor: David Michael Peltz, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 183 days.

(21) Appl. No.: 11/057,928

(22) Filed: Feb. 15, 2005

(65) Prior Publication Data

US 2005/0209777 A1 Sep. 22, 2005

Related U.S. Application Data

(60) Provisional application No. 60/555,112, filed on Mar. 22, 2004.

(51) Int. Cl.
*B61L 3/02* (2006.01)
*B61L 17/00* (2006.01)

(52) U.S. Cl. ..... 701/19; 701/117; 701/213

(58) Field of Classification Search ..... None
See application file for complete search history.

(56) References Cited

U.S. PATENT DOCUMENTS

| | | | | |
|---|---|---|---|---|
| 5,685,507 | A | 11/1997 | Horst et al. | |
| 6,222,484 | B1 * | 4/2001 | Seiple et al. | 342/357.09 |
| 6,377,179 | B1 * | 4/2002 | Fulton | 340/573.1 |
| 6,449,536 | B1 | 9/2002 | Brousseau et al. | |
| 6,470,245 | B1 | 10/2002 | Proulx | |
| 6,581,157 | B1 | 6/2003 | Chiles et al. | |
| 6,631,468 | B1 | 10/2003 | von Below | |
| 6,658,331 | B2 | 12/2003 | Horst et al. | |
| 6,691,005 | B2 | 2/2004 | Proulx | |
| 2002/0084387 | A1 | 7/2002 | Matheson et al. | |
| 2003/0040853 | A1 | 2/2003 | Brousseau et al. | |
| 2003/0144772 | A1 | 7/2003 | Proulx | |
| 2003/0178534 | A1 | 9/2003 | Peltz et al. | |
| 2003/0197608 | A1 * | 10/2003 | Rudhard et al. | 340/539.18 |
| 2004/0088086 | A1 | 5/2004 | Horst | |
| 2004/0167687 | A1 | 8/2004 | Kornick et al. | |

FOREIGN PATENT DOCUMENTS

| | | | |
|---|---|---|---|
| EP | 1 332 940 A | | 8/2003 |
| JP | 10-40483 | * | 2/1998 |
| WO | WO 2004/012019 | | 2/2004 |

* cited by examiner

*Primary Examiner*—Michael J. Zanelli
(74) *Attorney, Agent, or Firm*—Carlos Luis Hanze; W. David Sartor; Beusse Wolter Sanks Mora & Maire, P.A.

(57) ABSTRACT

A system (10) for generating a rail yard switch list (e.g., 30) of switch positioning activities for efficient movement of a railyard operator (12). The system includes a first operator control unit (14) (OCU) having a locator (16) for determining a location of the OCU and an associated operator using the OCU during rail yard switching activities. The system also includes a first processor (28) for correlating the rail yard switching activities with a respective location of the OCU in the rail yard to establish a knowledge base of respective preferred locations in the rail yard, and a memory (e.g. 26) for storing the knowledge base of preferred locations in the railyard. The system further includes a second processor (27) for receiving a request (32) for a switch list, accessing the memory, and processing the request based on the knowledge base to generate a switch list.

20 Claims, 1 Drawing Sheet

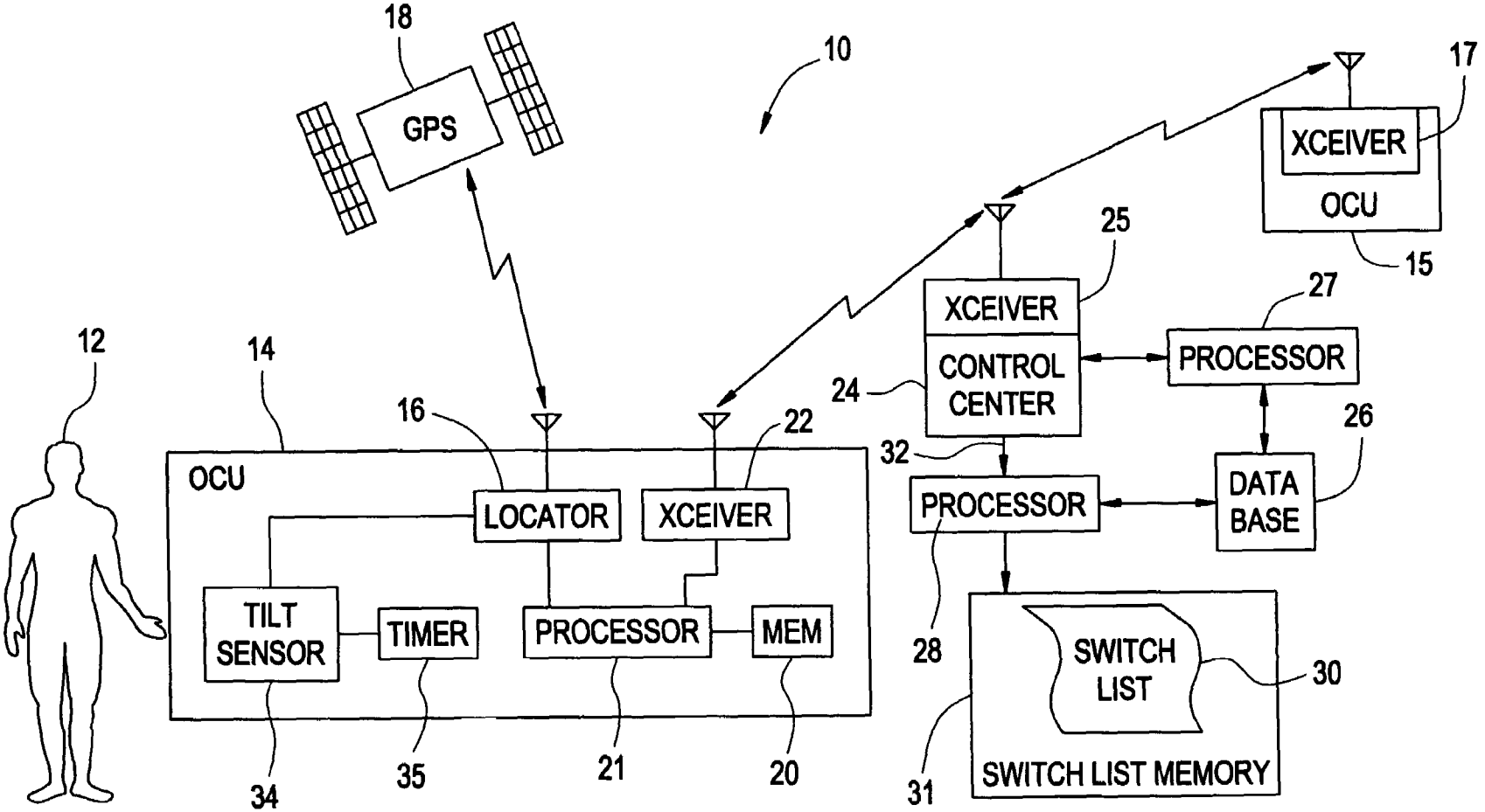
10
12
14
OCU
16
LOCATOR
22
XCEIVER
21
PROCESSOR
20
MEM
35
TIMER
34
TILT SENSOR
18
GPS
24
CONTROL CENTER
25
XCEIVER
32
27
PROCESSOR
26
DATA BASE
28
PROCESSOR
30
SWITCH LIST
31
SWITCH LIST MEMORY
15
OCU
17
XCEIVER

OPERATOR LOCATION TRACKING FOR REMOTE CONTROL RAIL YARD SWITCHING

RELATED APPLICATIONS

This application claims priority to U.S. Provisional Application Ser. No. 60/555,112 filed on Mar. 22, 2004, and incorporated herein by reference.

FIELD OF THE INVENTION

This invention relates to the field of remotely controlled locomotives, and, in particular, to tracking a location of an operator using a remote control system operator control unit (OCU) in a rail yard.

BACKGROUND OF THE INVENTION

Rail yards are used in the rail transportation environments to sort freight cars onto different track sections depending on each freight car's destination after leaving the yard. Yard switching refers to the transfer of a freight car or freight cars from one track to another, typically with the intent of assembling a train bound for a common destination designated for cars attached to the train for departure from the rail yard. In the past, switching of trains in a switchyard required a "switchman" on the ground at each end of the train to properly align the tracks and an engineer in a cab of a locomotive of the train in communication with the switchmen for moving the train down the desired tracks according to the switchmen's instructions. More recently, locomotives equipped with remote control systems have allowed the switchmen to control the movement of the locomotive in rail yard operations without requiring an engineer to control the locomotive. Modern remote control systems allow yard operators such as switchmen to control driverless, microprocessor-equipped switching locomotives controlled by an on-board Locomotive Control Unit (LCU) using a battery-powered portable Operator Control Unit (OCU) to be carried by an operator located adjacent to, but off-board of the locomotive to be controlled.

Typically, switchmen control switch placement and train movement through the yard according to switching sequences provided in a switch list. A switch list may be generated based on inbound trains arriving in the yard, the respective destinations of the cars within the arriving trains, and the destinations of outbound trains leaving the yard. Based on the switch list, the switchman determines a sequence of switch position settings and train movement onto the appropriate tracks corresponding to the switch position settings to accomplish assembly of trains according to the requirements of the switch list. However, switch lists are not typically organized so as to address the switch locations in the rail yard, nor the efficient movement of a switchman among these locations to control the switches.

BRIEF DESCRIPTION OF THE DRAWINGS

The sole FIGURE is a schematic representation of a system for tracking an OCU user's location in a rail yard to provide improved rail yard switching.

DETAILED DESCRIPTION OF THE INVENTION

Prior art rail yard switching schemes employing switch lists have failed to account for movement of the switchman throughout the rail yard to effect the desired train movement. Because some rail yards may encompass one a square mile of more of track switching area, switching sequences need to be organized to have efficient movement of the switchman throughout the yard. Switching sequences for a certain switch list may vary from switchman to switchman, with many sequences being inefficient and unnecessarily time consuming and burdensome. Experienced switchmen may be able to formulate switching sequences based on a certain switch list that results in reduced movement of the switchman throughout the yard and thus reduce switching times by reducing the need for the switchman to traverse long distances between switches in a switch sequence.

The inventor of the present invention has innovatively recognized that by tracking an efficient switchman's locations and movements in a switchyard, correlating these locations and movements to desired switching activities, and communicating the preferred movement plan to the respective switchman, overall rail yard switching efficiency may be improved. Thus the recommended switch list sequences for the movement of the switchmen throughout the rail yard are based on the best known sequences that have been tracked. Accordingly, the present invention improves rail yard switching efficiency by expanding the capabilities of an OCU to improve a switchman's ability to function in the context of the overall rail yard operations. The invention further provides enhanced productivity and safety of remote locomotive control switching operations in a rail yard by providing new locating and data processing capabilities to each switchman via a device he is already familiar with and has available (namely, the OCU) as described below.

A system 10 for tracking an OCU user's 12 location in rail yard to provide improved rail yard switching is illustrated in the figure as including an OCU 14 having a locator 16, such as GPS receiver in communication with a GPS satellite 18, for determining a location of the OCU 14. The OCU 14 may include a processor 21 in communication with a memory 20 for storing location information generated by the locator 16. The stored location information may be downloaded from the memory 20 for subsequent processing. In an aspect of the invention, the OCU 14 may also include a transceiver 22 in wireless communication with a control center 24, for example, located centrally in the rail yard. The control center 24 includes a transceiver f for transmitting to and receiving information from one or more OCU's 14, 15. Location information generated by the locator 16 may be communicated on a periodic basis, and/or upon request, to the control center 24, as the operator 12 moves through the rail yard to accomplish switching activities according to a switch list.

The location information gathered as an operator 12 moves through the yard may be used to develop a historical knowledge base correlating location of the operator within a rail yard with switching activities performed for a certain switch list. For example, a recognized efficient operator who has demonstrated movement-efficient switching selections based on a given switch list may be tracked by the system 10 to establish a historical knowledge base of switching sequence selections associated with respective rail yard locations. For example, the experienced operator may be able to review a switch list and choose a set of switching sequences from the list that may be performed from one local area within the rail yard, and a different set of switching sequences from the list that may be performed at another local area, so that the operator only needs to change his location from one local area to another for inputting an instruction at each location that in turn results in the completion of a set of multiple switch settings, instead of having to move from one local area to another for each switch selection in the switch list. The location information gathered for the experienced operator may be uploaded to the central controller 24 and stored in memory, such as a database 26. In addition, the switch positioning activities corresponding to the locations of the operator 12 when the switch positioning activities are performed may be transmitted to the central controller 24.

To develop the historical knowledge base, the location information may be correlated with respective switch position settings in a switch list as executed by the efficient operator 12. This correlated information may be used to establish preferred locations within the rail yard for representative sets of rail yard switching activities. Processor 27 may be configured for correlating the rail yard switching activities with a respective location of the OCU 14 in the rail yard to establish the knowledge base of respective preferred locations in the rail yard. Thereafter, the historical knowledge base may be accessed, for example, by processor 28, to organize the switching sequence of future switch lists 30, for example, stored in switch list memory 31, so that future switching activities may be performed with minimal physical movement of the operator. Accordingly, an inexperienced operator, for example, operating OCU 15, may be able to function more efficiently by following the sequence of switch position settings organized by the processor 28. The processor 28 may be configured to receive a switch list request 32 from the control center 24 and access the historical knowledge base stored in the database 26 to determine a movement efficient sequence of switching activities based on correspondence among switching activities in the switch list request 32 and historical switching activities and the rail yard location associated with the respective historical switching activities. The technical effect is to generate a switch list having a sequence of switching activities organized to consider the physical movement required of an operator to implement the switch list. In an aspect of the invention, processors 27 and 28 may comprise a single processor.

In an embodiment of the invention, correlation of location information and corresponding switching activities may be performed on board the OCU 12, such as by processor 21, and then transmitted, for example, via transceiver 22, to the control center for 24 for storing in the data base 26. In another embodiment, processor 21, in conjunction with memory 20, may be configured for correlating switching activities with locations, establishing a knowledge base, and organizing future switching activities based on the knowledge base, so that these functions may be performed on board the OCU 14. Accordingly, processor 21 and memory 20 may be configured to perform the functions of processors 27, 28, data base 26 and switch list memory 31. In yet another embodiment of the invention, OCU 15 may be equipped with a receiver 17 for receiving a switch list 30 from the control center 24.

Known neural network techniques may be used to determine an optimum switching sequence for a given switch list request 32 based on the historical knowledge base. For example, the neural network may be trained using switch sequence selections of a recognized efficient operator based on a certain switch list and corresponding switch locations in the rail yard. The trained neural network may then be used to configure efficiently sequenced switch lists based on switch requests input to the neural network.

The OCU 14 may include a tilt sensor 34, such as a mercury switch or a solid state device as disclosed in U.S. Pat. No. 6,691,005, coupled to the locator 16 and transmitter 22 for identifying a location of the OCU 14 when the tilt sensor detects that the OCU 14 has exceeded a certain inclination range for a certain amount of time. For example, the OCU 14 may include a timer 35 in communication with the tilt sensor to time occurrences of an inclination range being exceeded. Accordingly, location information may be transmitted to the control center 24 whenever the OCU 14 is tilted outside of the inclination range, such as may occur when an operator 12 of the OCU has fallen down, thereby allowing the location of the OCU 14 and, consequently, the operator 12 to be identified. If the OCU is tilted to a position at which it can no longer effectively communicate with the control center, the location of the last known location of the OCU is available in memory to more rapidly reach the OCU and switchman.

While various embodiments of the present invention have been shown and described herein, it will be obvious that such embodiments are provided by way of example only. Numerous variations, changes and substitutions will occur to those of skill in the art without departing from the invention herein.

The invention claimed is:

1. A system for generating a rail yard switch list of switch positioning activities for efficient movement of a railyard operator, the system comprising:

a first operator control unit (OCU) having a locator for determining a location of the OCU and an associated operator using the OCU during rail yard switching activities:

a first processor for correlating the rail yard switching activities with a respective location of the OCU in the rail yard to establish a knowledge base of respective preferred locations in the rail yard;

a memory for storing said knowledge base of preferred locations in the railyard for a library of the switching activities; and a second processor for receiving a request for a switch list, accessing the memory and processing the request based on the knowledge base to generate a switch list having a sequence of switching activities organized to consider the physical movement required of an operator to implement the switch list.

2. The system of claim 1, wherein the first OCU further comprises a transmitter for transmitting OCU location data to the first processor.

3. The system of claim 1, wherein the first OCU further comprises a transmitter for transmitting switch positioning activities to the first processor.

4. The system of claim 1, wherein the first processor is on the first OCU and the first OCU further comprises a transmitter for transmitting correlated data.

5. The system of claim 1, wherein the second processor communicates with a transmitter for transmitting the switch list.

6. The system of claim 5, further comprising a second OCU having a receiver for receiving the switch list.

7. The system of claim 6, wherein the first OCU constitutes the second OCU.

8. The system of claim 1, wherein the first processor, the second processor and the memory are on the first OCU.

9. The system of claim 1, wherein the first processor constitutes the second processor.

10. The system of claim 1, wherein the second processor is separate from and spaced apart from the first OCU.

11. The system of claim 1, further comprising:

an OCU tilt sensor for sensing an inclination of the OCU;

a transmitter, coupled to the tilt sensor and the locator for transmitting a signal indicative of the location of the OCU at times associated with when the inclination of the OCU exceeds a predetermined value.

12. The system of claim 11, further comprising a timer for measuring the period of time the inclination of the OCU exceeds the predetermined value.

13. The system of claim 12, wherein the OCU transmits a signal when the inclination of the OCU exceeds the predetermined value for a predetermined period of time.

14. A method for generating a rail yard switch list of switch positioning activities for efficient movement of a railyard operator, the method comprising:

tracking locations of a first operator control unit (OCU) and an associated operator during rail yard switching activities;

correlating each switching activity with a respective location of the operator to establish a knowledge base of respective preferred locations in a rail yard for a library of the switching activities;

storing the knowledge base in memory;

receiving a switch list request;

accessing the knowledge base; and processing the request based on the knowledge base to generate a switch list having a sequence of switching activities organized to consider physical movement of an operator implementing the switch list.

15. The method of claim 14, further comprising transmitting the switch list to a second OCU.

16. The method of claim 15, wherein the first OCU constitutes the second OCU.

17. The method of claim 14, further comprising transmitting data indicative of the tracked locations and the railyard switching activities.

18. A computer readable medium having software code for generating a rail yard switch list of switch positioning activities for efficient movement of a railyard operator, the computer readable medium comprising:

a software code module associated with an operator control unit (OCU) for tracking locations of a first OCU and an associated operator during rail yard switching activities:

a software code module associated with a first processor for correlating each switching activity with a respective location of the operator to establish a knowledge base of respective preferred locations in a rail yard for a library of the switching activities;

a software code module associated with memory for storing the knowledge base; and a software code module associated with a second processor for accessing memory and generating a switch list having a sequence of switching activities organized to consider physical movement of an operator implementing the switch list.

19. The computer readable medium of claim 18, further comprising a software code module for requesting the switch list.

20. The computer readable medium of claim 19, further comprising a software code module for transmitting the switch list.

* * * * *